United States Patent [19]

Iizuka et al.

[11] Patent Number: 4,863,048

[45] Date of Patent: Sep. 5, 1989

[54] CONTAINER WITH ELASTICALLY REVERSIBLE HINGE

[75] Inventors: Shigeo Iizuka, Funabashi; Isao Tanno, Fujioka, both of Japan

[73] Assignee: Yoshino Kogyosho Co., Ltd., Tokyo, Japan

[21] Appl. No.: 188,913

[22] Filed: May 2, 1988

[30] Foreign Application Priority Data

Oct. 21, 1986 [JP] Japan ..... 61-161454

[51] Int. Cl.[4] ..... B65D 43/16

[52] U.S. Cl. ..... 215/235

[58] Field of Search ..... 215/235, 237; 220/335

[56] References Cited

U.S. PATENT DOCUMENTS

| | | | |
|---|---|---|---|
| 227,137 | 5/1880 | Taylor | 215/235 |
| 2,111,186 | 3/1938 | Jenks | 215/235 X |
| 2,704,100 | 3/1955 | Freeman | 215/235 X |
| 4,082,201 | 4/1978 | Bittel | 220/339 |
| 4,216,862 | 8/1980 | Daenen | 220/337 X |
| 4,291,818 | 9/1981 | Nozawa | 215/235 X |

FOREIGN PATENT DOCUMENTS

| | | |
|---|---|---|
| 0180221 | 5/1986 | European Pat. Off. . |
| 50-126602 | 10/1975 | Japan . |

*Primary Examiner*—Donald F. Norton

*Attorney, Agent, or Firm*—Oliff & Berridge

[57] ABSTRACT

A container with an elastically reversible hinge comprising a container body having a neck which has a port, a cover engagable with the container body for opening or closing the port of the container body, and an elastically reversible hinge integrally formed on a part of a peripheral edge of the cover, wherein the elastically reversible hinge comprises a tongue-shaped attaching base having a pawl, integral hinges and an elastic piece of substantially L shape. Thus, the container with an elastically reversible hinge can eliminate the inconvenience associated with a cap which is troublesome to attach to or detach from the container, and the inconvenience of the removed cap being separated unintentionally.

4 Claims, 2 Drawing Sheets

CONTAINER WITH ELASTICALLY REVERSIBLE HINGE

BACKGROUND OF THE INVENTION

1. Field of the Invention

This invention relates to a container, such as a tubular container, an extruded container, etc.

2. Related Art

Heretofore, it is known that a container of this type has a threaded or a coupling type cap.

In this case, its cap is troublesome to be attached to or detached from the container, and it is inconvenient that the removed cap is separated unintentionally.

SUMMARY OF THE INVENTION

Accordingly, it is one object of this invention to provide a container with an .elastically reversible hinge which can eliminate the above-mentioned drawbacks of a conventional container.

In order to achieve the above and other objects, there is provided according to the present invention a container with an elastically reversible hinge comprising a container body 1 having a neck 12 which has a port 11, a cover 2 engagable with the port 11 for opening or closing the port of the container body 1 and an elastically reversible hinge 3 formed on a part of a peripheral edge of the cover Since the container is constructed as described above, the cover 2 is opened or closed by the elastically reversible hinge 3, and the hinge 3 can hold the cover 2 in he opened or closed state as it is.

The foregoing object and other objects as well as the characteristic features of the invention will become more fully apparent and more readily understandable by the following description and the appended claims when read in conjunction with the accompanying drawings.

DESCRIPTION OF THE PREFERRED EMBODIMENTS

Figure 1:
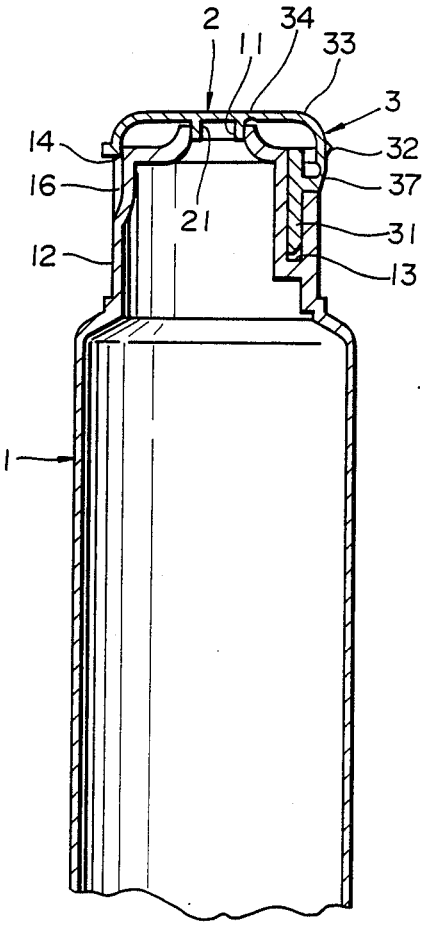
FIG. 1 is a longitudinal sectional side view of a first embodiment of a container with an elastically reversible hinge of the present invention.
Figure 2:
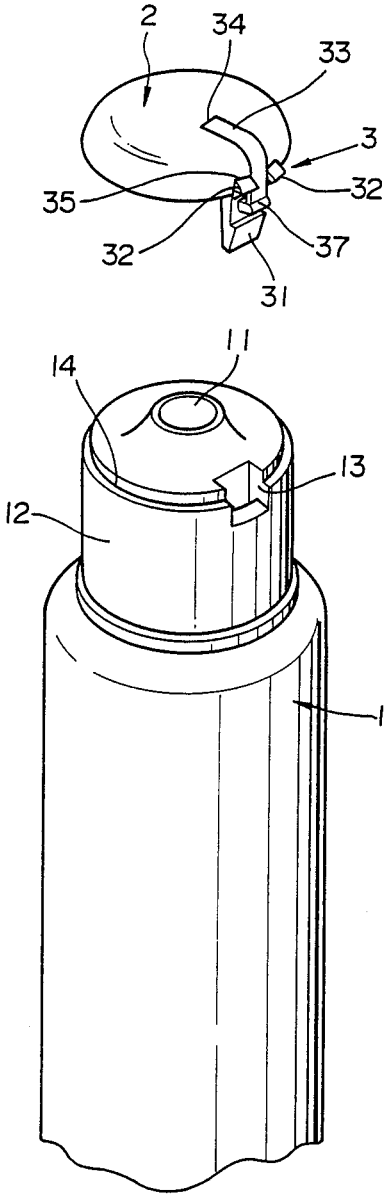
FIG. 2 is an perspective view of the first embodiment disengaging the cover.

Embodiments of a container with an elastically reversible hinge according to the present invention will be described with reference to the drawings. FIGS. 1 and 2 show a first embodiment of the invention.

A container is formed of a synthetic resin, and comprises a container body 1 having a neck 12, a cover 2 and an elastically reversible hinge 3. A reduced-diameter port 11 is formed at a top of the neck 12 of the container body 1. An engaging recess 13 is formed on a part of an upper peripheral wall edge of the neck 12 from an upper surface of the neck 12. A peripheral step 14 is formed at an upper peripheral wall edge of the neck 12. A pawl engaging recess 16 for disengaging the cover 2 is formed from the upper surface of the neck 12 at a radially opposite position to the engaging recess 13.

The cover 2 has a peripheral edge to be detachably engaged with the peripheral step 14 of the neck 12 on an inner surface of the cover 2. A plug cylinder 21 to be engaged with the port 11 of the neck 12 is projected from the inner surface of the cover 2. The cover 2 is molded with an elastic material.

The elastically reversible hinge 3 is formed at a part of the peripheral edge of the cover 2. A hinge attaching base 31 of the hinge 3 is inserted fixedly into the engaging recess 13.

The elastically reversible hinge 3 comprises the tongue-shaped hinge attaching base 31 having a pawl, integral hinges 32 and an elastic piece 33 of substantially L shape, and integrally molded with the cover 2. An upper end of the attaching base 31 connects to the peripheral edge of the cover 2 by means of the integral hinges 32, 32. The elastic piece 33 is provided between the integral hinges 32 and 32 at a position 34 near the center of the top surface of the cover 2 from an upper attachment 35 of the integral hinges 32, 32 and a position 37 of the base 31 below the integral hinges 32, 32. The cover 2 is pivotally rotated at the integral hinges 32, 32 as a rotating axis to be opened or closed from the container body. In other words, the integral hinges 32, 32 act as a first hinge. Ends 34, 37 of the elastic piece 33 act as a second hinge and third hinge, respectively. The elastically reversible hinge 3 is so formed that the elastic piece 33 is elongated to the maximum when the end 37, the integral hinges 32, 32 and the 34 are disposed along a rectilinear line. In the case of pivotally rotating the cover 2, when the end 37, the integral hinges 32, 32 and the end 34 are aligned along the rectilinear line an elastic reversion of the elastically reversible hinge 3 occurs.

Figure 3:
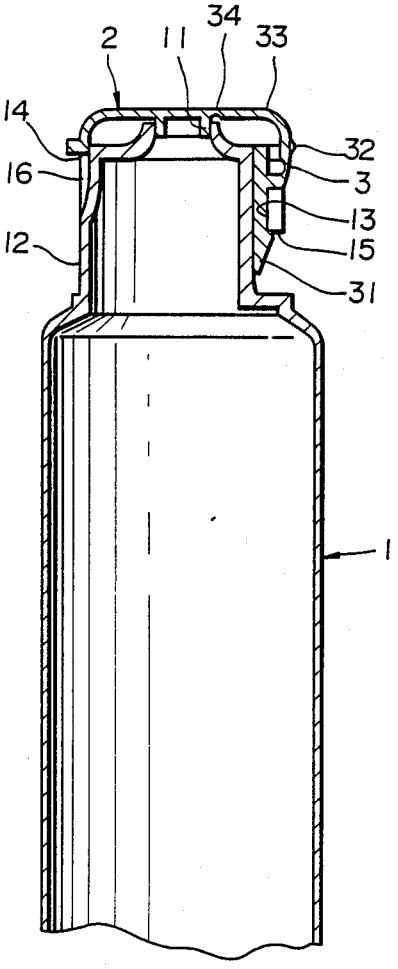
FIG. 3 is a longitudinal sectional side view of a second embodiment of a container with an elastically reversible hinge of the invention.
Figure 4:
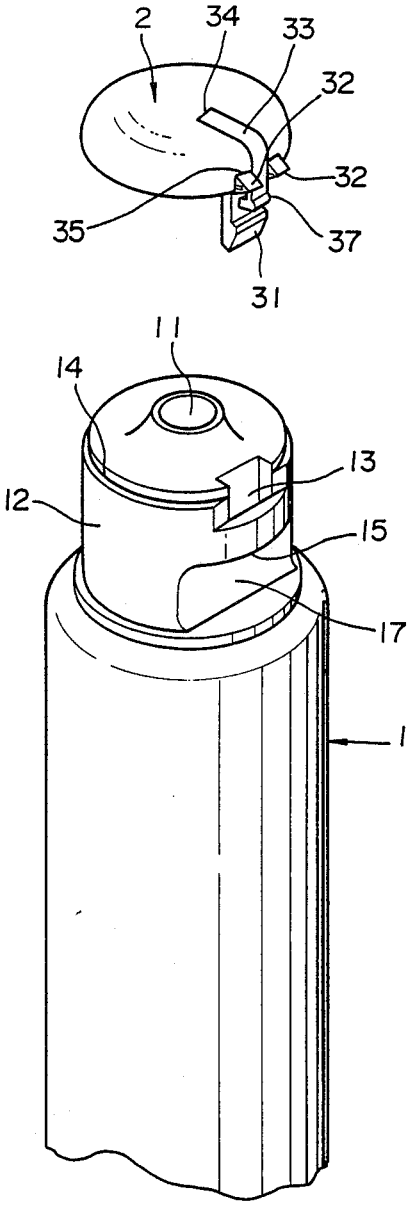
FIG. 4 is an perspective view of the second embodiment disengaging the cover.

FIGS. 3 and 4 show a second embodiment of a container with an elastically reversible hinge of the invention. A lower portion of the engaging recess 13 is cut out to be opened to form a cutout portion 17. The cutout portion 17 communicates with the engaging recess 13. The pawl of the hinge attaching base 31 is engaged with an upper edge 15 of the cutout portion 17.

According to the present invention as described above, the cover 2 of the container can be opened or closed by one-touch actuation. Since the elastically reversible hinge 3 is employed, the opening and closing states of the cover of the container can be held to be very convenient for use.

Consequently, the drawbacks of the conventional container can be eliminated, and the container with the elastically reversibly hinge can be provided inexpensively.

What is claimed is:

1. A container with an elastically reversible hinge comprising:

a container body having a neck, the neck having a port; and a cover engagable with the port for opening or closing the port of the container body;

wherein an elastically reversible hinge is integrally formed on a part of a peripheral edge of the cover, and the elastically reversible hinge comprises a tongue-shaped hinge attaching base having a pawl, integral hinges and an elastic piece of substantially L shape.

2. The container according to claim 1, wherein an engaging recess is formed on a part of an upper peripheral wall edge of the neck from an upper surface of the neck and the hinge attaching base is inserted fixedly into the engaging recess.

3. The container according to claim 1, wherein the cover is molded of an elastic material.

4. The container according to claim 2, wherein a cutout portion which communicates with the engaging recess is formed at a lower portion of the engaging recess and the pawl of the hinge attaching base is engaged with an upper edge of the cutout portion.

* * * * *